US006299147B1

(12) United States Patent
Mitter

(10) Patent No.: US 6,299,147 B1
(45) **Date of Patent: *Oct. 9, 2001**

(54) DEVICE FOR GENERATING A DEFINED RELATIVE HUMIDITY

(75) Inventor: Helmut Mitter, Hellmondsöd (AT)

(73) Assignee: E&E Elektronik GES m.b.H., Engerwitzdorf (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,025

(22) Filed: Sep. 24, 1999

(30) Foreign Application Priority Data

Sep. 25, 1998 (AT) ..... 622/98 U

(51) Int. Cl.[7] ..... B01F 3/04; G01C 25/00

(52) U.S. Cl. ..... 261/128; 261/135; 261/142; 73/1.06

(58) Field of Search ..... 261/128, 135, 261/142, 152; 73/1.06, 1.07

(56) References Cited

U.S. PATENT DOCUMENTS 3,659,604 * 5/1972 Melville et al. ..... 261/152
3,987,133 * 10/1976 Andra ..... 261/135
4,177,667 * 12/1979 Rolf et al. ..... 73/1.06
4,220,460 * 9/1980 Partus ..... 261/142
4,711,294 * 12/1987 Jacobs et al. ..... 261/128
5,457,983 * 10/1995 Sauvageau et al. ..... 73/1.06
5,502,659 * 3/1996 Braster et al. ..... 73/1.06
6,010,118 * 1/2000 Milewicz ..... 261/142

FOREIGN PATENT DOCUMENTS 9-257283 9/1997 (JP) .
9-257284 9/1997 (JP) .

OTHER PUBLICATIONS

P.H. Huang, Humidity Sensing, Measurements And Calibration Standards, Sensors, Feb. 1990, pp. 12–21.
Fischer & Porter: Differenzdruckregler 53 R 2110.

* cited by examiner

*Primary Examiner*—C. Scott Bushey
(74) *Attorney, Agent, or Firm*—Kenyon & Kenyon

(57) ABSTRACT

A device is provided for generating a defined relative humidity in a gas. This device includes a saturator chamber connected by at least one connecting line to a measuring chamber. The relative humidity in the measuring chamber can be adjusted by varying the pressures in the saturator chamber and in the measuring chamber. A valve unit is arranged in the connecting line. The valve unit and the portion of the connecting line located between the valve unit and the saturator chamber are in thermal contact with a heating device.

14 Claims, 3 Drawing Sheets

DEVICE FOR GENERATING A DEFINED RELATIVE HUMIDITY

BACKGROUND OF THE INVENTION

The present invention relates to a device for generating a defined relative humidity in a gas, and in particular for generating a defined relative humidity in air used in calibrating humidity sensors.

DESCRIPTION OF RELATED ART

As humidity sensors become used in more applications, such as in air conditioning technology, the need arises for devices which can be used to calibrate those sensors. Devices suited for this purpose are also known as "humidity generators". These devices supply a gas having a defined relative humidity value (RH) to a measuring chamber, in which can be placed the humidity sensors to be calibrated, or at least key components of those sensors.

One method for adjusting the relative humidity in a chamber is by using salt solutions, in accordance with DIN 50008. Another method uses so-called two-pressure/two-temperature humidity generators, that have also become widely used. In the latter method, air that is saturated with water vapor is produced in a saturator chamber at a temperature T1 and a pressure p1, and is subsequently expanded to a pressure p2 at a temperature T2 in a measuring chamber. The relative humidity in the measuring chamber can be determined by measuring the average pressures p1, p2 and temperatures T1, T2. Alternatively, by varying these parameters, the desired relative humidity RH can be obtained in the measuring chamber. Humidity generators of this type are described in the publication "Humidity Sensing, Measurements and Calibration Standards", P. H. Huang, Sensors, February 1990, pages 12–21.

The problem with humidity generators constructed in this manner is the relatively substantial investment needed to obtain the equipment, and in particular the components needed to perform temperature control, temperature measurements, and temperature stabilization.

A less expensive variation of this kind of humidity generator is a so-called two-pressure generator. In the two-pressure generator, appropriate measures are used to maintain equivalent temperatures in the saturator chamber and in the measuring chamber. The desired relative humidity RH is adjusted by merely varying the pressure ratio between the saturator chamber and the measuring chamber. The relative humidity is a function of the ratio of p1 and p2, given by the formula RH=f(p2/p1). All the quantities entering into this equation are measured or are given, so a desired RH can be obtained. Humidity generators of this kind are described, for example, in JP 09-257283. The theory of operation of these devices, thus, is that the desired relative humidity RH is adjusted by varying the pressure ratio of p1and p2.

However, there are several drawbacks associated with the known two-pressure humidity generator of this type. For example, vapor in the air that is fully saturated to RH=100% can condense out in the area between the saturator chamber and the valve unit, causing air that is no longer fully saturated to pass into the measuring chamber. This situation causes errors in the RH that is actually found in the measuring chamber.

Accordingly, there is a need for an improved device for providing gas having a defined relative humidity that obviates some of the drawbacks of currently known devices.

SUMMARY OF THE INVENTION

The present invention is directed to a device for generating a defined relative humidity in a gas that substantially obviates one or more of the problems due to limitations and disadvantages of the related art, and that is suitable for testing complete or disassembled humidity sensors. Additional features and advantages of the invention will be set forth in the description which follows, and in part will be apparent from the description, or may be learned by practice of the invention. Other advantages of the invention will be realized and obtained by the apparatus and method particularly pointed out in the written description and claims hereof, as well as the appended drawings.

One aspect of the present invention is thus a compact device having a simplest possible design for generating a defined relative humidity in a gas. The device also avoids the problems mentioned above of current humidity generators.

This objective is achieved by a device for producing a gas having a defined relative humidity, which includes a saturator chamber holding the gas at a pressure P1, a measuring chamber holding the gas at a pressure P2 connected to the saturator chamber via at least one connecting line. The relative humidity of the gas is adjusted by varying pressures P1 and P2. A valve unit is disposed in the connecting lines, and a heating device is in thermal contact with the valve unit and with a portion of the connecting lines between the saturator chamber and the valve unit.

In another embodiment, the invention is a method for generating a defined relative humidity in a gas, that includes introducing the gas at a first pressure in a saturator chamber, increasing the relative humidity of the gas to 100% in the saturator chamber, flowing the gas to a measuring chamber via a connecting line and a valve unit, and controlling a pressure regulator of the valve unit to obtain a second pressure in the measuring chamber lower than the first pressure. The method also includes controlling the ratio of the first pressure to the second pressure to obtain the defined relative humidity in the measuring chamber, and heating the valve unit and a portion of the connecting line.

The humidity generator according to the present invention ensure an extremely compact, simply designed device. In addition, the generator according to the present invention avoids the problem of vapor condensing in the area of the connecting conduit or valve unit upstream of the measuring chamber.

The construction of the generator according to the invention ensure a constant stream of gas into the measuring chamber, over the entire range of relative humidity values that can be produced by the device. The stream of gas into the measuring chamber does not fluctuate in response to varying relative humidity values. This feature is advantageous, because it improves the overall accuracy of the calibration system.

According to the invention, a device is created which makes it possible to produce a gas with desired relative humidity values RH simply by varying the pressure ratio between the two chambers. In particular, the amount of equipment required is considerably reduced as compared to known humidity generators, so that the resulting system can be easily assembled and transported.

One advantageous specific embodiment according to the present invention includes a two-pressure relative humidity generator. However, it is also possible to implement the scheme according to the present invention by using a two-pressure/two-temperature humidity generator.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute part of the specification, illustrate an embodiment of the invention and together with the description serve to explain the present invention. In the drawings.

DETAILED DESCRIPTION OF THE INVENTION

Figure 1:
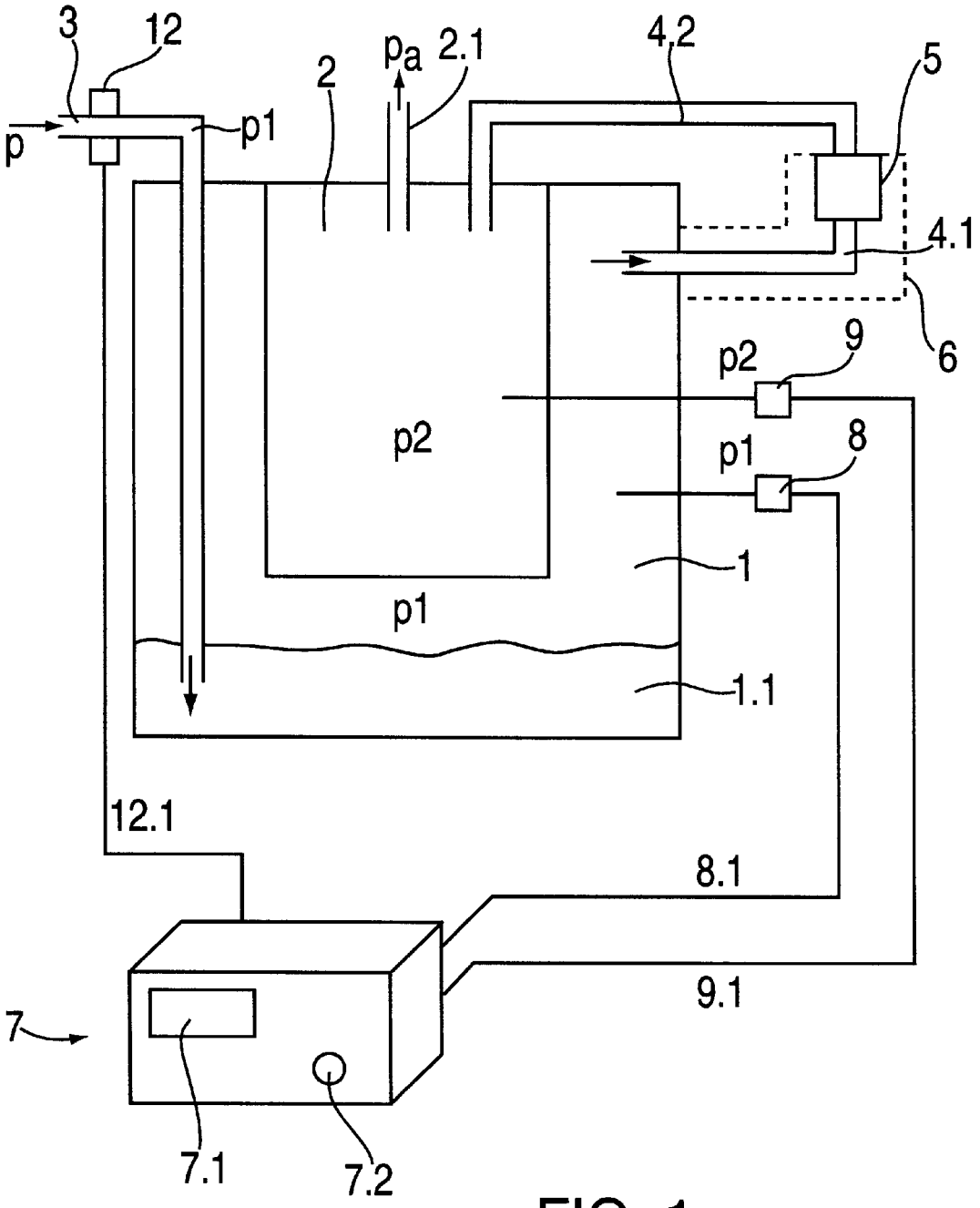
FIG. 1 is a schematic block diagram illustrating an exemplary embodiment of a device in accordance with the present invention.

An exemplary embodiment of the device in accordance with the present invention is described with reference to the illustration of FIG. 1. In this exemplary embodiment, the device for generating a defined relative humidity in a gas is essentially formed by one single unitary basic unit. A saturator chamber 1 and the actual measuring chamber 2 are both disposed within the basic unit. The complete basic unit is manufactured from a material having a high thermal conductivity. Aluminum, for example, is well suited for this purpose. Saturator chamber 1 includes an input side with a supply line 3, used to supply the saturator chamber 1 with air at a pressure p that is higher than atmospheric pressure. For example, this can be pressurized air from a compressor. A reducing valve 12 is used to obtain a desired pressure p1 in saturator chamber 1, so that p1 is lower than p. Saturator chamber 1 contains water 1.1, which is used to saturate the air entering saturator chamber 1 to a relative humidity RH=100%. In a different embodiment according to the invention, a gas other than air could be used in the humidity generator. For example, nitrogen can be used, so that it is produced with a defined relative humidity.

Following complete saturation, the air or other gas is directed via a connecting conduit formed by two sections 4.1, 4.2, and by a valve unit 5 into the actual measuring chamber 2. Measuring chamber 2, in turn, communicates via an open supply line 2.1 with the ambient environment, so that the pressure p2 in measuring chamber 2 is equalized with ambient pressure $p_a$.

According to the invention, the desired relative humidity RH can be obtained in the gas entering measuring chamber 2 by adjusting the pressure ratio p2/p1. The complete humidity sensors, or the components of the sensors that require calibration, can then be placed in measuring chamber 2 and the sensor's reading can be compared with the known value of RH in measuring chamber 2. The described exemplary embodiment is a two-pressure humidity generator but, as mentioned above, a two-pressure/two-temperature unit could be used, and the desired RH could be obtained by selecting the appropriate pressures and temperatures.

The embodiment shown in FIG. 1 also includes two pressure gauges 8, 9 for precisely measuring pressures p1, p2, respectively in saturator chamber 1 and in measuring chamber 2. It is thus always possible to determine the relative humidity RH of the gas by using the equation RH=K*(p2/p1). In the equation, K represents an empirically determined constant, referred to as the actual gas factor. The output signals from the two pressure gauges 8, 9 are fed for analysis or for further processing to an operational control unit 7, where relative humidity RH is computed using the equation specified above, and is displayed in a display area 7.1. In addition, operational control unit 7 can include control element 7.2 for selecting the desired relative humidity RH in measuring chamber 1.

Control element 7.2 acts on the reducing valve 12 via transmission line 12.1, to adjust pressure p1 at which the air in the saturator chamber is fully saturated. Relative humidity RH in measuring chamber 2 is adjusted to the desired value by setting pressure p1 with the control element 7.2, so that pressure ratio p2/p1 is ultimately selected. Signal transmission lines 8.1, 9.1 are schematically shown in FIG. 1 between operational control unit 7 and the humidity generator, and are used to make the values of p1 and p2 available to control unit 7.

The embodiment according to the present invention shown in FIG. 1 also includes a heating device 6, which is in thermal contact with specific parts of the humidity generator. Heating device 6 is in thermal contact with section 4.1 of the connecting line that runs between saturator chamber 1 and measuring chamber 2, and extends from saturator chamber 1 up to valve unit 5. Heating device 6 is also in thermal contact with valve unit 5. As a result, connecting conduit 4.1 and valve unit 5 are heated, to prevent the vapor in the air they contain, which is saturated to RH=100%, from condensing out. If that were to occur, it would have the effect of corrupting the relative humidity RH of the air in measuring chamber 2.

Figure 2A:
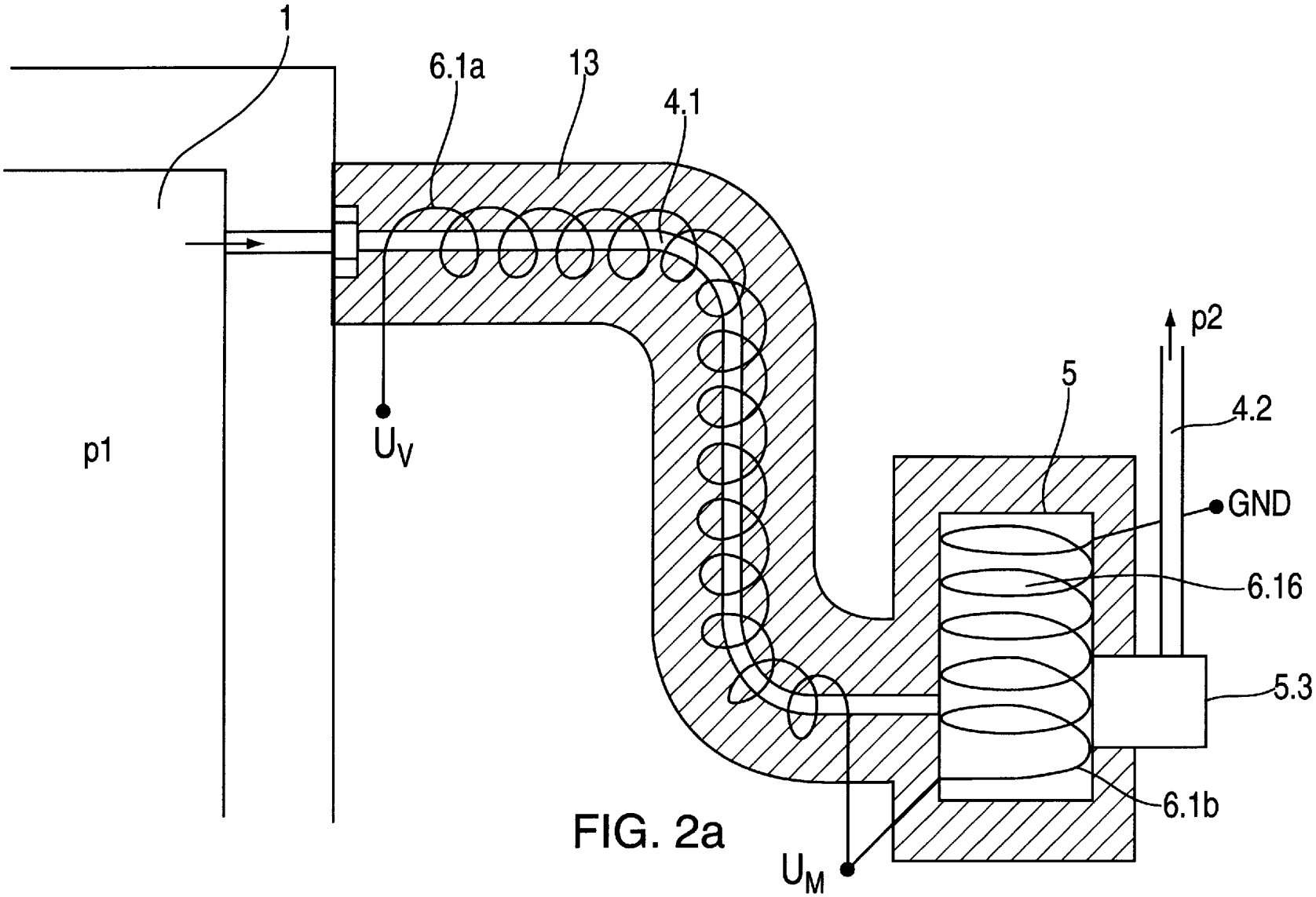
FIG. 2*a* is a detailed representation illustrating the heating device shown in FIG. 1.
Figure 2B:
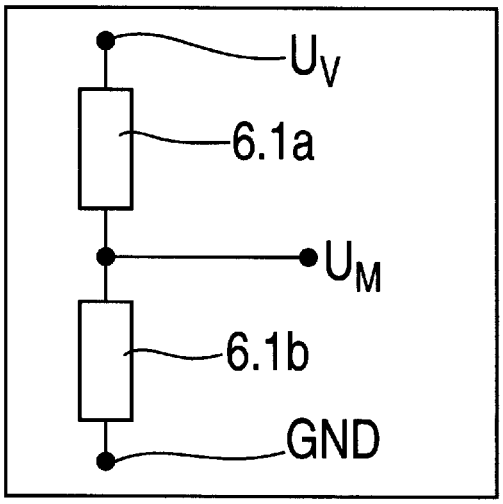
FIG. 2*b* illustrates the electric circuit diagram of the heating device shown in FIG. 2*a*.

Further details regarding the configuration of heating device 6 in accordance with the present invention are discussed as follows, with reference to FIGS. 2*a* and 2*b*. FIG. 2*a* shows a partial view of the exemplary embodiment shown in FIG. 1, and illustrates a detailed representation of heating device 6. FIG. 2*b* shows an electric circuit diagram of heating device 6.

Section 4.1 of the connecting line is shown in FIG. 2*a*, from saturator chamber 1 to the schematically depicted valve unit 5. In the illustrated exemplary embodiment, the heating device essentially includes a current-carrying resistance wire, which, in turn, is formed of two sections 6.1*a*, 6.1*b*.

First section 6.1*a* of the resistance wire is wound around connecting line 4.1 in the area between saturator chamber 1 and valve unit 5. In the depicted exemplary embodiment, the coils of resistance wire 6.1*a* are disposed such that approximately half of the length of resistance wire 6.1*a* is arranged in the first third of connecting line 4.1, measured beginning from saturator chamber 1.

Second section 6.1*b* of the resistance wire is wound around valve unit 5. FIG. 2*a* also illustrates an adjusting device 5.3 disposed near valve unit 5, that can be used to adjust the stream of gas into measuring chamber 2 as desired.

In addition, an insulating layer 13 is arranged around area 4.1 of the connecting line and around valve unit 5. Insulating layer 13 contains the specific sections of resistance wires 6.1*a* and 6.1*b*, and is used to thermally insulate heating device 6 from the ambient environment. The insulation can be, for example, commercial PU foam or other commercial prefabricated tubular insulation.

In the illustrated exemplary embodiment, the two resistance wires 6.1*a*, 6.1*b* of the heating device are connected in series and have contacts $U_V$ and GND to enable connection to a suitable voltage supply. In addition, a contact $U_M$ is provided between the two resistance wires 6.1*a*, 6.1*b*, so that a control voltage can be tapped and used to test for correct functioning of the heating device. The electric circuit diagram corresponding to the depicted exemplary embodiment of a heating device is illustrated in FIG. 2*b*. In one possible specific embodiment, an electrical resistance of about 100 Ω can be selected for each of the two resistance wires 6.1*a*, 6.1*b*. The supply voltage applied to contact $U_V$ in one embodiment of the invention can be about 24 V. In this embodiment, the heating device is conceived as a simple constant power heating coil. The sizing and design of the heating device can result, for example, in a heating of about 5–7° C., which is independent of the prevailing ambient temperature. The heating takes place in the area 4.1 of the connecting line as well as in the area of valve unit 5.

The temperature existing in these areas is at least slightly above the saturation temperature of the air coming from the saturator chamber. These measures make it possible to reliably prevent the water vapor contained in the highly saturated air emanating from the saturator chamber from condensing out in these areas of the device, and affecting the RH in the measuring chamber 2.

Figure 3:
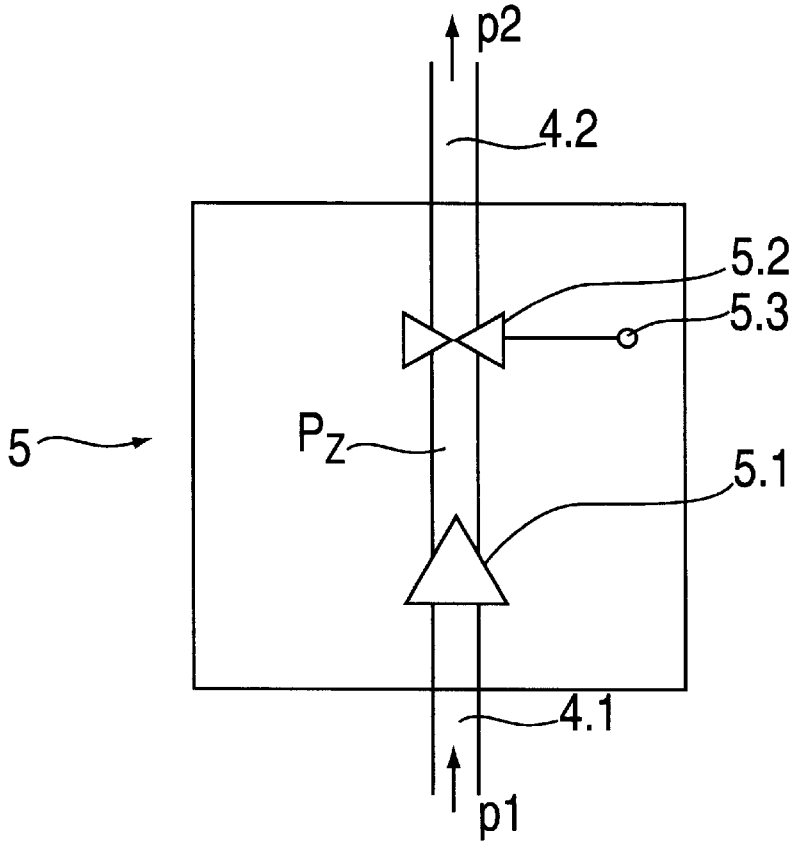
FIG. 3 is a detailed view illustrating the valve unit shown in FIG. 1.

A detailed view of valve unit 5 is shown in FIG. 3. For the sake of clarity, the heating device is not shown in this Figure. In the present invention, valve unit 5 preferably includes a differential pressure regulator 5.1, which is arranged on the inlet side. Valve unit 5 has a downstream needle valve 5.2, which in the depicted specific embodiment also includes adjusting element 5.3. Adjusting element 5.3 of needle valve 5.2 can be used, for example, to select a desired amount of gas stream entering in the measuring chamber 2.

Differential pressure regulator 5.1 is located on the inlet side of valve unit 5, and maintains the air up to adjusting element 5.3 at a constant pressure $p_z$. The air stream reaching the measuring chamber through needle valve 5.2 is thus constant, independently of the input-side fluctuations in air pressure p1 in saturator chamber 1. The connecting line between differential pressure regulator 5.1 and needle valve 5.2 is maintained at an intermediate pressure $p_z$, which is about 150 mbar above pressure p2, and is kept constant. Needle valve 5.2 then allows the gas to expand from $p_z$ to p2, with p2 corresponding as a rule to the ambient pressure $p_a$.

Regulating intermediate pressure $p_z$ to constant value $p_z$=p2+150 mbar, in accordance with the present invention, thus ensures a substantially constant pressurization of needle valve 5.2 independently of the value of adjusted pressure p1. In this manner, a substantially constant mass rate of flow through valve unit 5, and a substantially constant gas stream in the measuring chamber is ultimately obtained. This proves to be greatly advantageous, for instance for calibrating humidity sensors in the measuring chamber, because a constant gas stream is a prerequisite for accurate calibration. The appropriate differential pressure regulators 5.1 can be obtained, for example, from the firm Fischer & Porter under the designation "differential pressure regulators, series 53R_2110".

Valve unit 5 includes a differential pressure regulator 5.1, a needle valve 5.2 and, optionally, an adjusting device 5.3. By using an appropriate pressure regulator 5.1, an intermediate constant pressure $p_z$ of about 150 mbar above p2 is obtained in the connecting line between pressure regulator 5.1 and needle valve 5.2. The air at the intermediate pressure $p_z$ is ultimately expanded via the needle valve to a lower pressure p2, which is typically equal to the ambient pressure. By maintaining intermediate pressure $p_z$ at a constant value $p_z$=p2+150 mbar, a constant pressurization of the needle valve is ensured independently of the variable pressure p1, resulting in a constant gas stream entering the measuring chamber 2.

Alternative designs are possible in addition to the embodiments described above. For example, a different heating device can be used, consisting of preassembled heating bands. In the same way, a more costly specific embodiment could also include performing a temperature measurement, and adjusting the heating temperature with any known type of temperature regulator. However, in all embodiments it is important that both the first section of the connecting line and the valve unit be in thermal contact with the heating device in question.

Other configurations are possible for the specific geometry of the two chambers, as well as for the particular shape of the connecting lines. It will be apparent to those skilled in the art that various modifications and variations can be made in the structure and the methodology of the present invention, without departing from the spirit or scope of the invention. Thus, it is intended that the present invention cover the modifications and variations of this invention provided they come within the scope of the appended claims and their equivalents.

What is claimed is:

1. A device for producing a gas having a defined relative humidity, comprising:

a saturator chamber holding the gas at a pressure P1;

a measuring chamber holding the gas at a pressure P2, connected to the saturator chamber via at least one connecting line, wherein a relative humidity of the gas is adjusted by varying pressure P1 relative to pressure P2;

a valve unit disposed in the at least one connecting line; and a heating device in thermal contact with the valve unit and a portion of the at least one connecting line between the saturator chamber and the valve unit.

2. The device as recited in claim 1, wherein a temperature in the measuring chamber is substantially the same as a temperature in the saturator chamber.

3. The device as recited in claim 1, wherein the saturator chamber is larger than the measuring chamber, and forms with the saturator chamber a unitary assembly.

4. The device as recited in claim 3, wherein the unitary assembly is formed of a thermally conductive material.

5. The device as recited in claim 1, wherein the heating device is adapted to heat the connecting line and the valve unit to a temperature above a saturation temperature of the gas in the saturator chamber.

6. The device as recited in claim 1, wherein the heating device comprises a temperature controller for adjusting a heating power.

7. The device as recited in claim 1, wherein the heating device is a current-carrying resistance wire.

8. The device as recited in claim 1, wherein the valve unit provides a substantially constant flow of gas from the saturator chamber to the measuring chamber.

9. The device as recited in claim 8, wherein the valve unit further comprises a differential pressure regulator disposed adjacent an input portion of the valve unit, and an adjustable needle valve disposed downstream of the differential pressure regulator.

10. The device as recited in claim 7, further comprising a thermal insulation surrounding the resistance wire.

11. The device as recited in claim 1, further comprising a control unit having at least one control element for selecting a relative humidity produced in the measuring chamber and a display unit for displaying the selected relative humidity.

12. The device as recited in claim 11, wherein the control element operates a reducing valve disposed at an inlet of the saturator chamber.

13. A method of producing a gas having a defined relative humidity, comprising:

introducing the gas at a first pressure in a saturator chamber;

saturating the gas to a relative humidity of 100% in the saturator chamber;

flowing the gas to a measuring chamber via a connecting line and a valve unit;

controlling a pressure regulator of the valve unit such that the first pressure is greater than a second pressure in the measuring chamber;

controlling the ratio of the first pressure and the second pressure to obtain the defined relative humidity in the measuring chamber; and heating the valve unit and a portion of the connecting line.

14. The method according to claim 13, further comprising controlling a needle valve of the valve unit to obtain a constant flow of the gas.

* * * * *